United States Patent [19]

Fort

[11] 4,205,714

[45] Jun. 3, 1980

[54] APPARATUS FOR THE CENTRIFUGAL CASTING OF TUBULAR BODIES

[75] Inventor: Pierre Fort, Nancy, France

[73] Assignee: Pont-a-Mousson S.A., Nancy, France

[21] Appl. No.: 954,030

[22] Filed: Oct. 23, 1978

[30] Foreign Application Priority Data

Nov. 4, 1977 [FR] France ..... 77 33223

[51] Int. Cl.[2] ..... B22D 13/10

[52] U.S. Cl. ..... 164/301; 164/299

[58] Field of Search ..... 164/298, 299, 300, 301, 164/286, 114

[56] References Cited

U.S. PATENT DOCUMENTS

| | | | |
|---|---|---|---|
| 2,267,896 | 12/1941 | Bridewell et al. | 164/301 |
| 2,267,958 | 12/1941 | Szwed | 164/301 |
| 2,523,558 | 9/1950 | Cavallier | 164/300 |
| 3,456,716 | 7/1969 | Lorang | 164/301 |

FOREIGN PATENT DOCUMENTS

| | | | |
|---|---|---|---|
| 987406 | 8/1951 | France | 164/301 |

*Primary Examiner*—Robert D. Baldwin
*Assistant Examiner*—Gus T. Hampilos
*Attorney, Agent, or Firm*—Sughrue, Rothwell, Mion, Zinn and Macpeak

[57] ABSTRACT

This apparatus having two pouring channels comprises a support which is movable in a direction perpendicular to the axis of the mould in synchronism with the carriage which carries the two pouring channels and to the same extent of travel as the carriage so as to support the free end of the two channels when the centrifugal casting machine and the carriage are moved away from each other. The support is rigid with the centrifugal casting machine as concerns movement in translation in a direction parallel to said axis and is provided with transverse shifting means synchronized with the means for shifting the carriage.

9 Claims, 8 Drawing Figures

X
X
1
2
50
51
24
23
27
28
9a
9b
T
U
25
26
58
59
29
32
34
52
53
7a
7b
54
55
56
57
22
10
P
f

APPARATUS FOR THE CENTRIFUGAL CASTING OF TUBULAR BODIES

The present invention relates to an apparatus for the centrifugal casting of tubular bodies, of the type comprising, on one hand, a centrifugal casting machine carrying a rotary mould, on the other hand, an iron supply unit for the mould comprising two pouring channels which are rigid at their upstream end with a common carriage which is movable in a direction perpendicular to the axis of the mould between two positions, the supply unit and the mould being longitudinally movable relative to each other in each position of the carriage, a support movable in a direction perpendicular to said axis in synchronism with the carriage and through the same travel being provided for supporting the free end of the two channels when the machine and the carriages are moved away from each other.

French Pat. No. 987 406 discloses an apparatus of this type.

Generally, in apparatus having two pouring channels, the carriage brings in turn each of the two channels into the pouring position with respect to the mould, the other channel being placed to one side in a position for maintenance and preparation for the following pouring.

The two channels are thus supported by their upstream end forming a chute, whereas their end having the pouring mouth and a large part of their length is in overhanging relation. If no additional support were provided, the jerking produced by the arrival of the carriage at the end of its travel would consequently vibrate the free end of the two channels, especially as the latter have a small section to enable them to enter the mould. Indeed, apparatus having two pouring channels are in practice only used for moulds of small diameter, for example less than 300 mm. If the pouring is initiated immediately after the stoppage of the carriage, these vibrations would still be felt and would have an adverse effect on the obtainment of pipes of good quality. It would consequently be necessary to await the complete stoppage of the vibrations of the channels before each pouring and this would reduce the production rate.

This drawback is overcome in the aforementioned French Pat. No. 987 406 owing to the support which is movable in a direction perpendicular to said axis in synchronism with the carriage and effecting the same travel. Indeed, with such a support, the vibrations of the channels are eliminated or at any rate very reduced.

However, in this patent, the movable support is connected to the carriage. Consequently, in order to permit the mould to approach the carriage, a complicated pivotal system must be provided to withdraw the movable support.

An object of the invention is to considerable simplify this known apparatus. For this purpose, the invention provides an apparatus of the aforementioned type wherein the support which is movable in a direction perpendicular to said axis is constituted by one side of an articulated parallelogram structure whose opposite side is perpendicular to the axis of the mould and fixed to the centrifugal casting machine and is provided with transverse displacement means which are synchronized with the means for displacing the carriage.

Preferably, the support comprises a withdrawable inverted U-shaped cage for the lateral guiding of each of the channels. The pouring mouth ends of the channels are then maintained or guided on three generatrices, two being lateral and opposed and the third being a lower generatrix which ensures a perfect stability of the channels and a practically complete elimination of the vibrations.

Further features and advantages of the invention will be apparent from the ensuing description with reference to the accompanying drawings which are given merely by way of example and in which.

Figure 1:
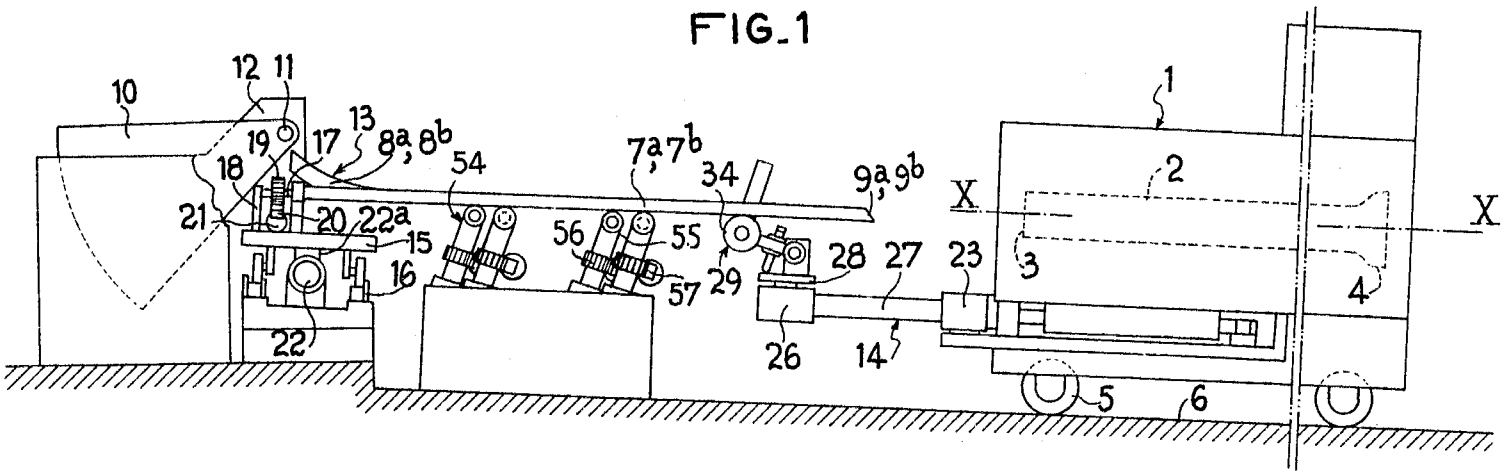
FIG. 1 is a diagrammatic side elevational view, to a reduced scale, of an apparatus for centrifugally casting iron pipes according to the invention.
Figure 6:
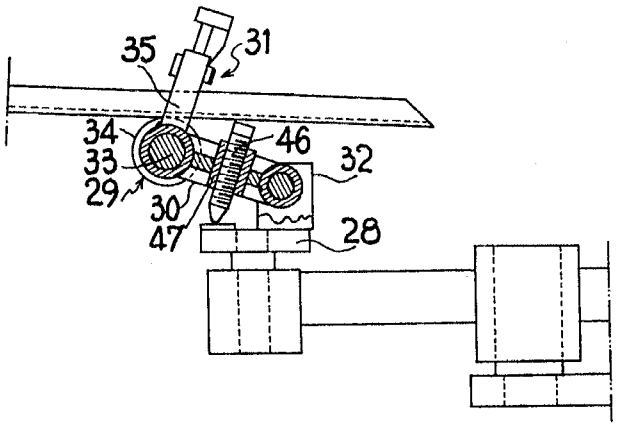
FIG. 6 is a partial elevational view to the same scale as FIG. 3, along line 6—6 of FIG. 3, illustrating the system for adjusting the height of the end of the channels, and, FIG. 7 is a diagrammatic plan view, to a small scale, similar to FIG. 3, of a modification of an apparatus according to the invention.

In the embodiment shown in FIGS. 1 to 6, the invention is applied to an apparatus for centrifugally casting iron pipes of small diameters, that is to say diameters less than for example about 300 mm. It concerns a machine of the Lavaud type, that is to say a machine having a pouring channel of great length and small section capable of travelling through the entire length of the centrifugal casting mould so as to pour therein progressively the liquid iron as it is withdrawn from the mould. In the known manner, the apparatus comprises a centrifugal casting machine 1 consisting of a carriage, carrying a centrifugal casting mould 2 having an axis of rotation X—X which is slightly inclined relative to the horizontal. The mould 2 is shown diagrammatically in dotted line without its system for driving it in rotation or its cooling system, which may be a water jacket or a water spraying system. This mould comprises an upper smooth cylindrical end 3 and a lower enlarged socket end 4. The machine 1 is provided with wheels 5 and is capable of rolling along a slightly sloping track 6 under the action of a suitable device such as a jack (not shown).

The apparatus further comprises, in the extension of the machine 1 toward the upper end of the track 6, a pair of pouring channels *7a, 7b* having parallel axes T—T and U—U, which form a plane which is roughly parallel to the axis X—X of the mould 2 and which may even contain this axis X—X. Each channel *7a, 7b* has a trough-shaped cross-section with an outside profile which is roughly in the shape of three quarters of a circle and has an upstream end the most remote from the machine 1 which is enlarged in the form of a chute *8a, 8b* for receiving the liquid iron and a downstream end in the form of a pouring mouth *9a, 9b* which is adapted to enter the mould 2 and travel therethrough internally throughout the length of the mould. The length of the channels 7a, 7b is therefore a little greater than that of the mould 2. Each channel 7a, 7b is of the turn-over type described hereinafter.

In order to render the drawing more simple, the means for cleaning and coating the mould 2 which may equip each channel 7a, 7b have not been shown.

Each channel 7a, 7b is supplied with liquid iron by a single tiltable ladle 10 of known type which has the shape of a flat sector of a cylinder having vertical parallel sides and a radius which is much larger than the height of the cylinder, this height constituting the constant width of the ladle 10. The ladle 10 is pivotally mounted by a fixed shaft 11, in the vicinity of its edge pouring the liquid iron, on a fixed frame 12. The median plane P—P of the ladle 10 contains the axis X—X of the mould 2 (FIG. 2).

The apparatus further comprises a system for supporting, guiding and moving in translation the channels 7a, 7b. This system comprises a first support 13, a second support 14 for the channels, and jacks for shifting these supports.

Figures 2, 2A:
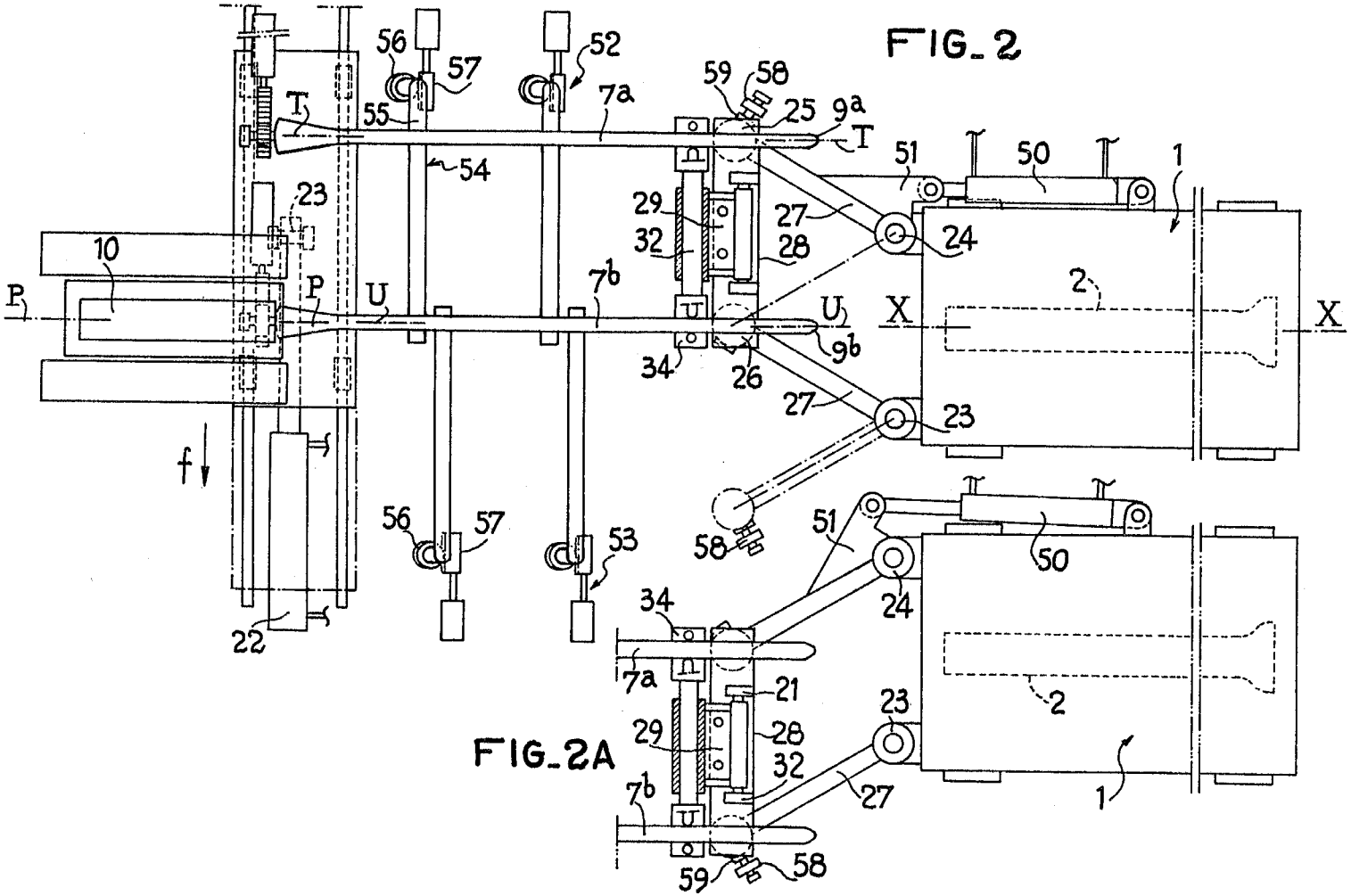
FIG. 2 is a plan view of the apparatus shown in FIG. 1, the carriage occupying a first position.
FIG. 2A is a partial view similar to FIG. 2, the carriage occupying its other position.
Figure 3:
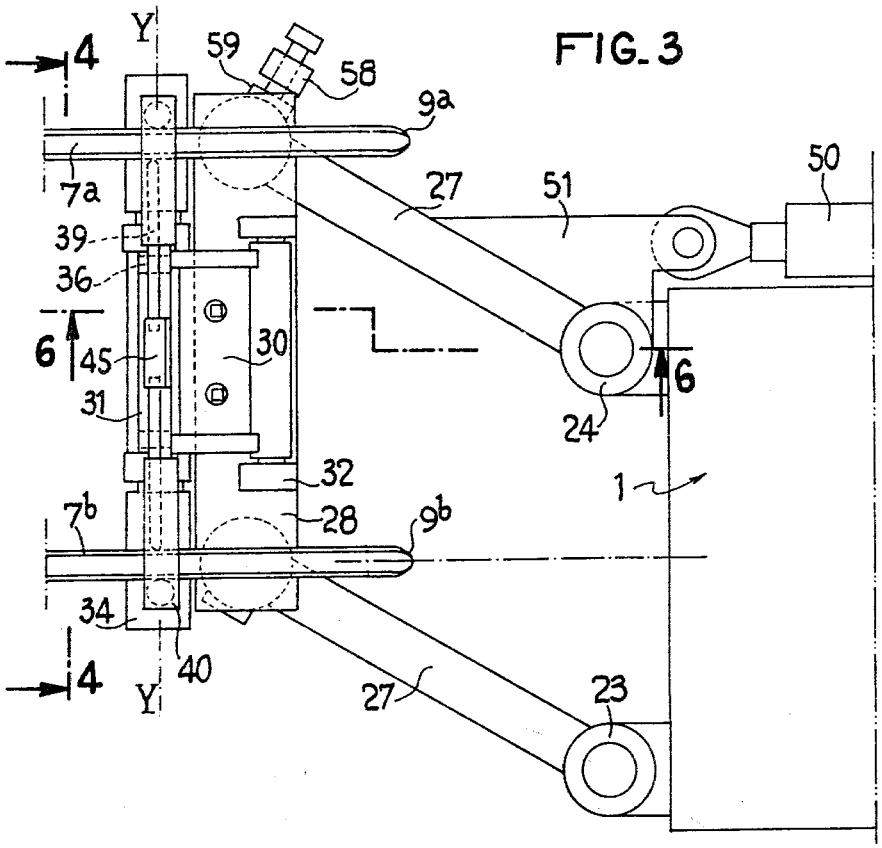
FIG. 3 is a partial plan view, to an enlarged scale, of the articulated parallelogram structure which acts as a support for for the ends of the two pouring channels, with this view being swung around in the horizontal plane in order to render the drawing more clear.

First support 13 (FIGS. 1 and 2).

This support is on the whole of known type. It comprises a transverse carriage 15 which rolls on a horizontal track 16 having rails which are orthogonal to the axes X—X, T—T and U—U and centered on the plane P—P. The transverse carriage 15 acts as a support for the upstream end of the two channels 7a, 7b through two devices for turning these channels over so as to empty the remainder of the iron which has solidified after each pouring. More precisely, each turning device is adapted to turn through 180° a trunnion 17 fixed to each channel 7a, 7b in the extension of the axis of the latter under the chute 8a, 8b and supported by one or two bearings 18 which project from the carriage 15 and are adjustable in height. The trunnion 17 is for example driven in rotation by a gear pinion 19 fixed thereto and cooperating with a horizontal rack 20 which is actuated by a jack 21 carried by the carriage 15. This device is of the type described in detail in French Pat. No. 1 002 389. As there are two channels 7a, 7b, the two turning devices are mounted in parallel on the transverse carriage 15, the racks 20 being in the extension of each other.

The carriage 15 is shifted along the track 16 by a jack 22 which is fixed to the ground and has a piston rod which engages a lug 22a projecting under the carriage. The travel of the carriage corresponds to the travel of the jack 22 and is limited by two end-of-travel stops (not shown). In each position of the carriage, the axis of one of the two channels is in the plane P—P, the chute 8a, 8b of this channel being under the pouring edge of the ladle 10.

Second support 14 (FIGS. 1 to 6)

The second support 14 is the essential part of the invention. It comprises generally a parallelogram structure contained in a plane parallel to the track 6 and having four articulations or pivots 23 to 26 which are substantially vertical and constitute the corners of the parallelogram structure. The parallelogram structure comprises a pair of parallel arms 27 contained in a plane parallel to the plane of the axes T—T and U—U of the channels and below the latter. When viewed in plan, the arms 27 are oblique relative to the axes X—X, T—T and U—U and constitute two sides of the parallelogram structure. The other two sides, having corners 23–24 and 25–26 respectively, are orthogonal relative to the axes X—X, T—T and U—U. The pivots 23 and 24 are carried by bearings fixed to the end of the machine 1 which is the nearest to the carriage 15. The pivots 25 and 26 are connected by a cross-member 28 which embodies the fourth side of the parallelogram structure.

The cross-member 28 is part of support means or cradle for the zone of the channels 7a, 7b which is the nearest to the machine 1. More precisely, each channel is supported by the cross-member 28 through a pivoted L-shaped section member 29 (FIGS. 3 and 6) which has a flange 30 roughly horizontal and a flange 31 roughly vertical. The flange 30 is pivoted at its free end by means of two bearings 32 fixed to the cross-member 28 so as to be freely journalled about an axis parallel to the cross-member 28. The right angle corner of the L-section member 29 has extending therethrough a shaft 33 on each end of which is freely rotatably mounted a roller 34 having an axis Y—Y. Each roller 34 acts as a support for a channel 7a, 7b. The other flange 31 of the member 29 is constituted by a double plate 35 (FIGS. 4 and 5) on which are pivotally mounted, by pins 36 perpendicular to the plate, two yokes 37 for laterally guiding each channel 7a, 7b. Each yoke 37 is withdrawable and forms with the corresponding roller 34, in the swung over position, a rectangular cage 38 for guiding a channel. For this purpose, each yoke comprises a sector 39 on the upper face of which is fixed a projecting plate 40. The free end of the latter carries a bar 41 for affording a lateral guiding outside a channel which is part cylindrical and freely rotatable relative to the plate 40. In the active position of the yokes 37 (FIG. 4), the cross-section of a channel 7a, 7b is therefore supported and guided on three generatrices thereof, a lower generatrix bearing on the roller 34 and the other two lateral generatrices, which are in opposed relation, being in contact with the two parallel sides of the cage 38 formed by the sector 39 and the bar 41, the lower ends of these two elements being slightly spaced above the roller 34. By way of a modification, there could be provided a pivoted sector 39-40-41 which is in one piece and notched with the opening lowermost in accordance with the same rectangular section, or sectors which are not pivoted with the plate 35 but easily disassembled for disengaging as desired the channels 7a, 7b.

Figure 4:
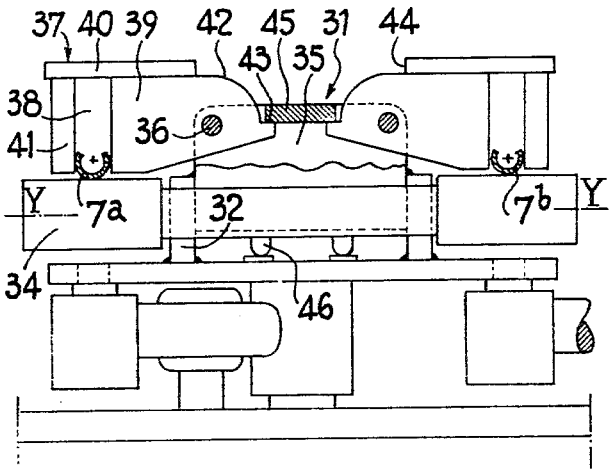
FIG. 4 is a partial elevational view to the same scale as FIG. 3, along line 4—4 of FIG. 3 with a part cut away.
Figure 5:
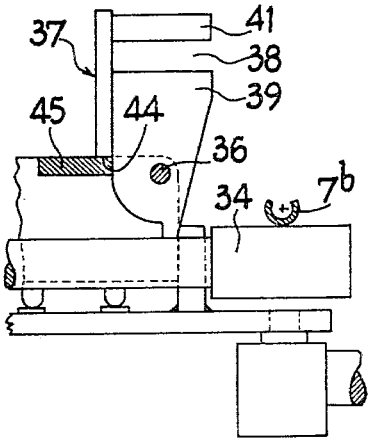
FIG. 5 is a partial view corresponding to FIG. 4 and showing a channel guide in the withdrawn position of the channel.

For the purpose of the rotation and withdrawal of each yoke 37 for releasing and disengaging a channel 7a, 7b (FIG. 5), each sector 39 has an inner upper section 42 in the shape of quarter of a circle defined by the shoulders 43 and 44 which cooperate with an abutment 45 rigid with the plate 35 of the L-section member 29 (FIGS. 4 and 5). The abutment 45 is by its active faces parallel to the flange 30.

The L-section member 29 is completed by a device for adjusting in height which comprises a pair of screws 46 which extend in a direction perpendicular to flange 30 of the L-section member and bear against the upper face of the cross-member 28. For this purpose, the flange 30 has a pair of nuts 47 in each of which each regulating screw 46 can be screwed or unscrewed. The two screws 46, which are adjusted to the same height, ensure that the L-section member 29 is stable. By adjusting both the screws 46 and the height of the bearings 18 of the carriage 15 it is thus possible to modify the vertical position of the channels 7a, 7b in the plane P.

The member 29 for supporting and guiding the channels bears therefore on the cross-member 28, on one hand, through the bearings 32 and, on the other hand, by the ends of the adjusting screws 46, the heads of the latter being provided with a setting square. Moreover, the cross-member 28 is itself supported in an overhanging relation through the articulated parallelogram structure 14 by the centrifugal casting machine 1. The articulated parallelogram structure 14 is shifted by a jack 50 whose body is pivotally mounted on one side of the machine 1. The piston of this jack is pivoted to a member 51 carried by an arm 27 of the parallelogram structure 14. Shown in full lines in FIG. 2 are the positions of the arms 27 in which the channel 7*b* is in the pouring position, and in dot-dash lines (full lines in FIG. 2A), the positions of the arms 27 in which it is the channel 7*a* which is in this pouring position.

The jacks 22 and 50 are of the double-acting hydraulic type. The means for supplying fluid thereto are of known commercially-available type (not shown) comprising distributing slide valves for putting the jacks under pressure and connecting them to the exhaust, a common electric drive, also of known type and commercially available, actuates in synchronism these slide valves so as to actuate in synchronism the jacks 22 and 50.

The apparatus is completed by two pairs of withdrawable intermediate supports 52, 53 which are adjustable in height and are shown diagrammatically in FIGS. 1 and 2. Each support 52, 53 comprises an elbow 54 at 90° having a horizontal branch 55 and a branch which is inclined to the vertical and is parallel to the plane P—P. The inclined branch is rigid with an inclined gear pinion 56 which is actuated by a jack-rack system 57. These supports are described in detail in the aforementioned French Pat. No. 1 002 389.

The branches 55 of the pairs of supports are normally oriented towards each other and perpendicular to the plane P. The free end of the branches 55 of the pair 52 are then to one side of that of the branches 55 of the pair 53, as can be seen in FIG. 2. When the carriage 15 is in the position shown in FIG. 2 or in its other position shown in FIG. 2A, the channel 7*b* or 7*a* being in the plane P, the pairs 52 and 53 support the median part of the channels 7*a* and 7*b*. The jacks 57 are capable of pivoting the supports 52, 53 through about 90° so as to withdraw the branches 55. The position of the pinions 56 is such that the cross-member 28 of the parallelogram structure 14 can then freely pass these supports so as to approach the carriage 15.

The apparatus just described operates in the following manner:

Assuming initially that a pipe has just been poured by means of the channel 7*b*, the latter is therefore in the extension of the mould 2 completely withdrawn from the latter, its axis U—U being in the vertical plane P containing the axis X—X of the mould. The machine 1 is in the lower position (FIGS. 1 and 2). The supports 52, 53 are in the active position for supporting the median part of the channels.

The twin channel 7*a* is in the position of rest. During the pouring, which has just finished, this channel 7*a* has been subjected to maintenance and preparation operations for the following pouring.

For the purpose of changing the pouring channel, the jacks 22 (for the transverse carriage 15) and 50 (for the parallelogram structure 14) are put under pressure in synchronism by means of the suitable pipes. The following movements occur then simultaneously:

The jack 22 shifts the carriage 14 in the direction of arrow f (FIG. 2). This carriage 15 rolls along the track 16 until it reaches its end-of-travel stop, the axis T—T of the channel 7*a* arriving then in the vertical plane P. The carriage 15 reaches its end-of-travel stop in a manner which is hydraulically damped by the jack 22 and therefore occurs without jerks.

The jack 50 turns the arms 22 of the parallelogram structure about the pivots 23 and 24 which are rigid with the machine 1 which is stationary. The other two pivots enable the cross-member 28 and the L-section member 29 to move in a direction parallel to themselves in a circular movement of translation centered on the pivots 23, 24 and having for radius the distance between the pivots 23 and 26, that is to say, the length 27 of the parallelogram structure.

This movement continues until an end-of-travel stop 58, which is fixed relative to the ground, is reached by a boss 59 of the bearing 26 and positions the cross-member 28. The movement is damped hydraulically at the end of the travel by the jack 50. The stop 58 is therefore reached without jerks.

In the course of these two simultaneous and synchronized movements, each channel 7*a*, 7*b* is maintained, as described before, at its upstream end 8*a*, 8*b* by its rotating trunnion 17 on the bearings 18 which are fixed to the carriage 15, and in the vicinity of its downstream end, 9*a*, 9*b* by the supporting and guiding cage 58.

The cross-member 28 moves practically without friction and without jerking owing to the driving thereof by the deformation of the articulated parallelogram structure P. The pouring mouth end 9*a*, 9*b* is maintained and guided in the cage 38 along three generatrices and this cage 38 is itself supported at two support points, one being constituted by the bearings 32, and the other by the adjusting screws 46 and the upper face of the cross-member 28. Consequently, there is great stability in the course of the movement, and the channel is put in the pouring position and stays there without any jerking or vibrations (FIG. 2A).

Before the following pouring, the machine 1 rises toward the pouring ladle 10 on its track 6. In the course of this rising travel, the articulated parallelogram structure 14, which is connected to travel in translation with this machine, moves with the latter and the cages 38 slide on the channels 7*a*, 7*b* along which the rollers 34 roll and the bars 41 and the sectors 39 slide. This rising travel of the machine 1 can start at the end of the lateral displacement of the channels owing to the absence of vibrations of the latter.

When the cross-member 28 approaches the supports 52, 53, a switch (not shown) causes the automatic withdrawal of the supports which permit the channels 7*a* to enter the mould 2 up to the region corresponding to the socket 4. The metal is poured in the mould by the return of the machine 1 toward the lower end of the track 6 until its reaches its initial position and a simultaneous tipping of the ladle 10. The aforementioned switch returns the supports 52, 53 to the active position thereof as soon as the cross-member 28 has past them.

During these two travels of the machine 1, the supporting and the guiding of the pouring channels 7*a*, 7*b* along three generatrices are therefore maintained without any jerking or vibrations, which permits an absolutely regular pouring of the iron into the mould 2. Note that friction between the support 14 and the channels is very small owing to the provision of the rolling means 34 and 41. Moreover, there could be provided by way of a modification a third rolling means to complete the cage 38.

In order to put the channel *7a* in the position of rest and the channel *7b* in its operative position, the jacks 22 and 50 are then actuated simultaneously so that the carriage 15 and the cross-member 28 return to their initial position shown in FIG. 2 under the same conditions as before.

For maintenance (scraping, blackening etc.), or for dismantling a channel *7a, 7b,* it is merely necessary to release the trunnion 17, by opening the bearing or bearings 18 at the upstream end, and raise the sector 39 so as to cause it to rotate about the journal 36 until the shoulder 41 abuts the stop 45 (FIG. 5) which releases the downstream end. FIG. 5 clearly shows that the channel *7b* is completely disengaged. Each channel can be thus mounted and dismantled individually or both channels may be mounted and dismantled simultaneously.

Figure 7:
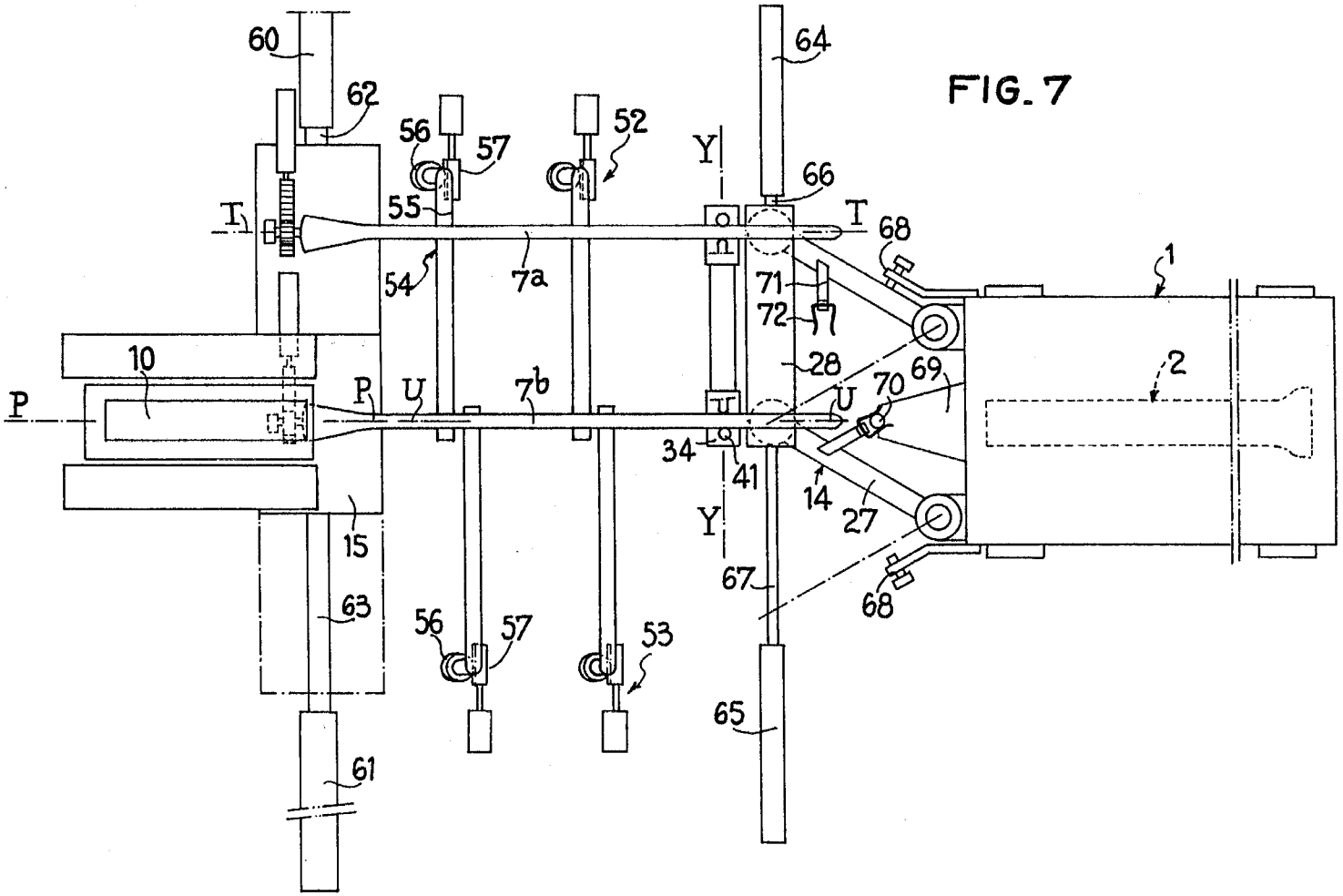

The modification shown in FIG. 7 differs from the foregoing embodiment by the mode of displacement of the carriage 15 and of the cross-member 28 (for reasons of simplification, the mounting of the L-section member 29 on the cross-member 28 has not been shown in FIG. 7).

The carriage 15 is subjected successively to the actions of two opposed jack-thrust members 60, 61 secured to the ground and having thrust rods 62, 63 which are oriented in a direction orthogonal to the axes T—T and U—U and in the extension of each other.

The cross-member 28 is subjected, also directly and in succession, to the actions of two opposed thrust jacks 64, 65 having thrust rods 66, 67 which are parallel to the jacks 60, 61 and have the axis Y—Y of the rollers 34. The jacks 64, 65 have the same travel as the jacks 60, 61. They are secured to the ground and are located in facing relation to the cross-member 28 when the machine 1 is in the lower position shown in FIG. 7. In order to enable these jacks to operate correctly, the dimension of the cross-member 28 transversely of the axis Y—Y exceeds the displacement in this direction of the cross-member when it moves in circular translation due to the deformation of the parallelogram structure 14.

The articulated parallelogram structure 14 consequently no longer performs the driving function for the cross-member 28, but only a supporting and guiding function therefor. Each arm 27 of the articulated parallelogram structure cooperates with a stop 68 fixed to the machine 1 and defining an end-of-travel of the parallelogram structure which is hydraulically damped as before by the jacks.

There is also provided an automatic locking of the parallelogram structure 14 on the machine 1 in each of its end positions by means of elastically yieldable fasteners. For this purpose, the machine 1 has in its axial vertical plane P a horizontal bracket 69 which extends towards the carriage 15 and carries a vertical locking bar 70. Each arm 27 of the articulated parallelogram structure 14 carries a suitably oriented projection 71 which is provided at its end with an elastically yieldable fastener 72 constituted by a spring steel blade having a profile roughly in the shape of an Ω. These blades engage in turn the vertical bar 70 by gripping the latter by their constricted part. Such an elastic locking replaces that obtained in the preceding embodiment by maintaining the jack 50 under pressure.

This modification shown in FIG. 7 permits facilitating the synchronization of the movements of the carriage 15 and of the cross-member 28 in the direction parallel to the axis Y—Y. Otherwise, the structure and operation are the same as before.

I claim:

1. In an apparatus for centrifugally casting tubular bodies, comprising a centrifugal casting machine having a rotary mould rotatable about an axis, an iron supply unit for supplying iron to the mould and comprising a carriage which is movable in a direction perpendicular to the axis of the mould between two positions, two metal pouring channels having upstream ends mounted on the carriage and free downstream end portions, the iron supply unit and the machine being longitudinally movable relative to each other in each position of the carriage between a first relative position in which one of the channels is inserted in the mould and a second relative position in which the channel is withdrawn from the mould, a support structure carried by said machine and movable in a direction substantially perpendicular to said axis of rotation of the mold between two positions in synchronism with the carriage and to the same extent of travel as the carriage for supporting the free end portion of the two channels when the machine and the supply unit are in said second relative position; the improvement wherein the support structure comprises two parallel arms with one end of each arm being connected to said machine to pivot about first axes contained in a first plane substantially perpendicular to said axis of rotation of the mold and support means connected to each of said arms to pivot about second axes contained in a second plane parallel to said first plane, said pivotal connections constituting the articulations of a deformable articulated parallelogram structure defined by the interrelationship between said arms, support means and machine through said pivotal connections.

2. An apparatus as claimed in claim 1, wherein the support means comprises a cross-member on which are rotatably mounted two support rollers for respectively supporting the channels, said support rollers having substantially horizontal axes of rotation which are substantially perpendicular to the axis of the mould.

3. An apparatus as claimed in claim 1, further comprising two withdrawable yokes, which are inverted U-shaped in cross section, carried by the support means, each yoke being placed over a corresponding one of said channels so that branches of the inverted U-shaped yoke laterally guide the channel.

4. An apparatus as claimed in claim 3, wherein at least one of the branches of the inverted U-shaped yoke is defined by an upwardly extending freely rotatable roller for rolling guiding contact with the corresponding channel.

5. An apparatus as claimed in claim 3 or 4, wherein each yoke is mounted on the support means to pivot about a substantially horizontal axis for pivotally withdrawing the yoke from the corresponding channel.

6. An apparatus as claimed in any one of the claims 1 to 4, wherein the support means comprises a cross-member and a plate, mounted adjacent a first end of the plate on the cross-member, pivotable about a substantially horizontal axis and carrying adjacent an end of the plate opposed to said first end, members on which the channels respectively bear.

7. An apparatus as claimed in any one of the claims 1 to 4, comprising means for shifting the support means including a jack which has a first end which is operatively connected to one of the arms and is pivotally connected to the machine adjacent an end of the jack opposed to said first end of the jack.

8. An apparatus as claimed in any one of the claims 1 to 4, comprising means for shifting the support means including two spaced apart transverse jack-thrust means which are fixed relative to the ground and are operative in directions transverse to said axis of rotation of said mold and are located in facing relation to each other and to the support means, each one of the transverse jack-thrust means being associated with an end of said support means in said second relative position of the supply means and the casting machine.

9. An apparatus as claimed in any one of the claims 1 to 4, comprising releasable means carried by the arms for automatically locking the support structure to the casting machine in each position of the support structure.

* * * * *